United States Patent [19]

Kato et al.

[11] Patent Number: 4,599,770

[45] Date of Patent: Jul. 15, 1986

[54] ROLL FOR ROLLING MILL

[75] Inventors: Heiji Kato; Hiroyuki Shiozaki, both of Yokosuka, Japan

[73] Assignee: Ishikawajima-Harima Jukogyo Kabushiki Kaisha, Japan

[21] Appl. No.: 597,260

[22] Filed: Apr. 6, 1984

[51] Int. Cl.[4] ..... B21B 31/16; B21B 27/02

[52] U.S. Cl. ..... 29/113 R; 29/117; 29/125; 72/243

[58] Field of Search ..... 72/241, 243, 19, 20; 29/113 AD, 116 AD, 113 R, 116 R, 125, 117

[56] References Cited

U.S. PATENT DOCUMENTS

| | | | |
|---|---|---|---|
| 2,241,669 | 5/1941 | McConnell | 29/117 |
| 2,651,241 | 9/1953 | Hornbostel | 29/117 |
| 4,062,096 | 12/1977 | Eibe | 29/113 AD |
| 4,423,541 | 1/1984 | Marshall | 29/125 X |

FOREIGN PATENT DOCUMENTS

| | | | |
|---|---|---|---|
| 0068107 | 5/1980 | Japan | 72/241 |
| 0097806 | 6/1982 | Japan | 72/243 |
| 0196106 | 11/1983 | Japan | 29/116 AD |

*Primary Examiner*—Lowell A. Larson
*Assistant Examiner*—Steven B. Katz

[57] ABSTRACT

In a roll of the type in which a sleeve is fitted over a roll core, the sleeve is expanded radially outwardly so that the roll profile is varied optimumly depending upon a complex profile or cross section of a strip to be rolled.

2 Claims, 16 Drawing Figures

ROLL FOR ROLLING MILL

BACKGROUND OF THE INVENTION

The present invention relates to a roll for rolling mill which can attain the precision of strip thickness in the width-wise direction of a strip and which can control various complex profiles of strips.

In FIG. 1 is shown a most conventional four-high rolling mill comprising backup rolls a and work rolls b. The four-high rolling mill is disadvantageous in that when a strip d is rolled whose width is shorter than the length of the work rolls b, the work rolls b are curved or bent as indicated by two-dot chain lines e so that the crown of the rolled strip is increased. In order to prevent the crown from being increased, there has been employed a method in which the work rolls have a crown.

There has been also employed a method in which the crown of the work rolls is controlled. That is, as shown in FIG. 2, a sleeve g is fitted over a roll core f and an oil chamber h is formed at the center portion of the roll core f; oil under high pressure is forced into the oil chamber h so that the sleeve g is expanded and consequently the crown of the roll is controlled. However, as shown in FIG. 3, the sleeve g which is made into contact with a mating roll i is caused to bend or deflect and high stresses are developed at portions j. Therefore such rolls are adapted to be used in a cold rolling for rolling a strip under a low rolling force, but are not adapted to be used in a hot strip mill or plate mill which rolls the strip under a high rolling force.

There has been also used the so-called bending control method in which forces in the opposite directions are exerted to the shafts of the work rolls b. This method is disadvantageous in that bending is prevented at portions A of contact between the work roll b and the backup roll a so that no satisfactory result cannot be attained. As a result, a correct cross section profile cannot be obtained (See FIG. 1).

In order to solve the above and other related problems, there have been proposed various methods. One example is to axially offset intermediate rolls c in a six-high rolling mill as shown in FIG. 4. The above problems have been satisfactory overcome by this method, but new problems have arised. That is, the number of rolls is increased and the pressure distribution at the surfaces of contact become nonuniform in the axial directions of the rolls. Furthermore the maximum value of such pressure is considerably increased so that wear of the rolls is enhanced, resulting in increase of the roll maintenance cost. Moreover the housing becomes high so that is is easily lengthened due to load. In addition, since the intermediate rolls are offset in their axial directions, the rolls are damaged. The six-high rolling mill is symmetrical about the center point in construction so that when the strip d is deviated from the center of the rolling mill, the zig-zag movement of the strip d tends to occur very frequently. Furthermore when the six-high rolling mill is provided with only a pair of bearing boxes, it becomes difficult to roll the strip with a complex cross section profile.

It has been proposed a further improvement. As shown in FIG. 5, both ends of a backup roll a are chamfered so that the end portions of the work rolls b and the backup rolls a are out of contact with each other. According to this method, a strip with a relatively small width can be satisfactorily rolled; but when a strip with a relatively large width is rolled, the work rolls are not positively backed up at their portions which are in contact with side edge portions of the strip so that the side edge portions of the rolled strip are increased in thickness, resulting in formation of a negative crown.

In view of the above, the present invention has for its object to provide a roll for a rolling mill which can substantially overcome the above and other problems so that the correct cross section profile can be obtained and the rolling efficiency can be improved.

The above and other objects, effects and features of the present invention will become more apparent from the following description of the preferred embodiments thereof taken in conjunction with the accompanying drawings.

DETAILED DESCRIPTION OF THE PREFERRED EMBODIMENTS

Figure 1:
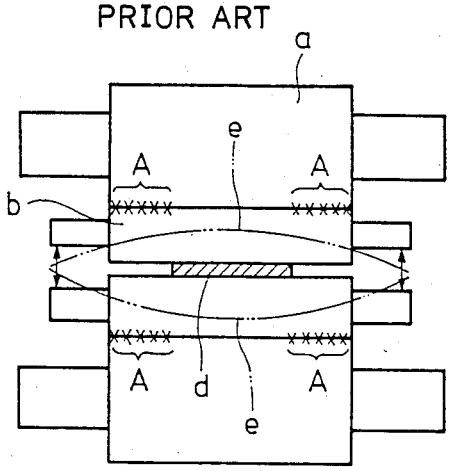
Fig. 1 PRIOR ART
FIG. 1 is a diagrammatic view of a conventional rolling mill.
Figure 2:
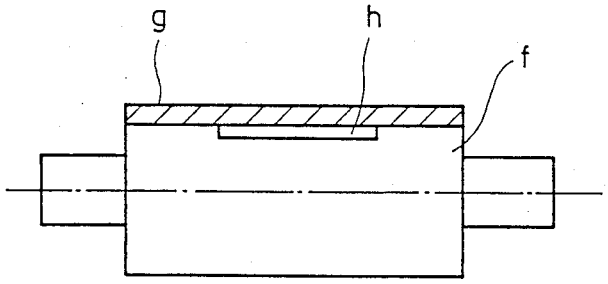
Fig. 2 PRIOR ART
FIG. 2 is a schematic view of a conventional crown roll.
Figure 3:
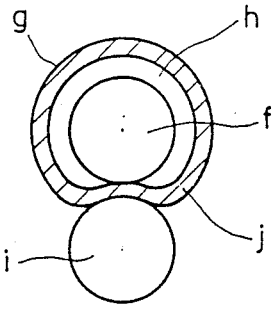
Fig. 3 PRIOR ART
FIG. 3 is a view used to explain the operation of the conventional crown roll shown in FIG. 2.
Figure 4:
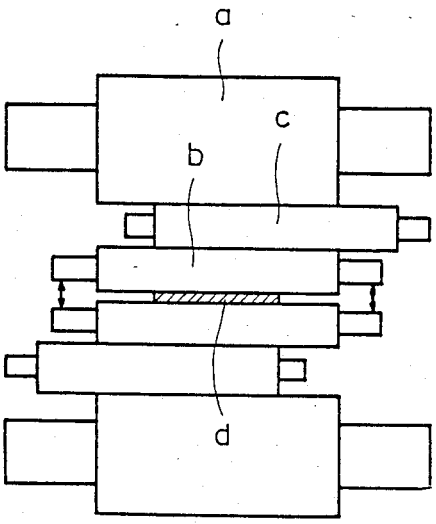
Fig. 4 PRIOR ART
FIG. 4 is a schematic view of a conventional six-high rolling mill.
Figure 5:
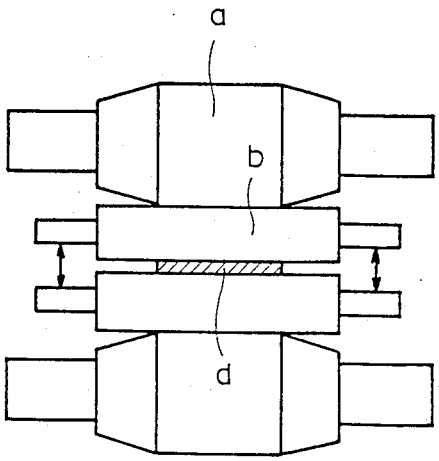
Fig. 5 PRIOR ART
FIG. 5 is a schematic view of a conventional four-high rolling mill.
Figure 6:
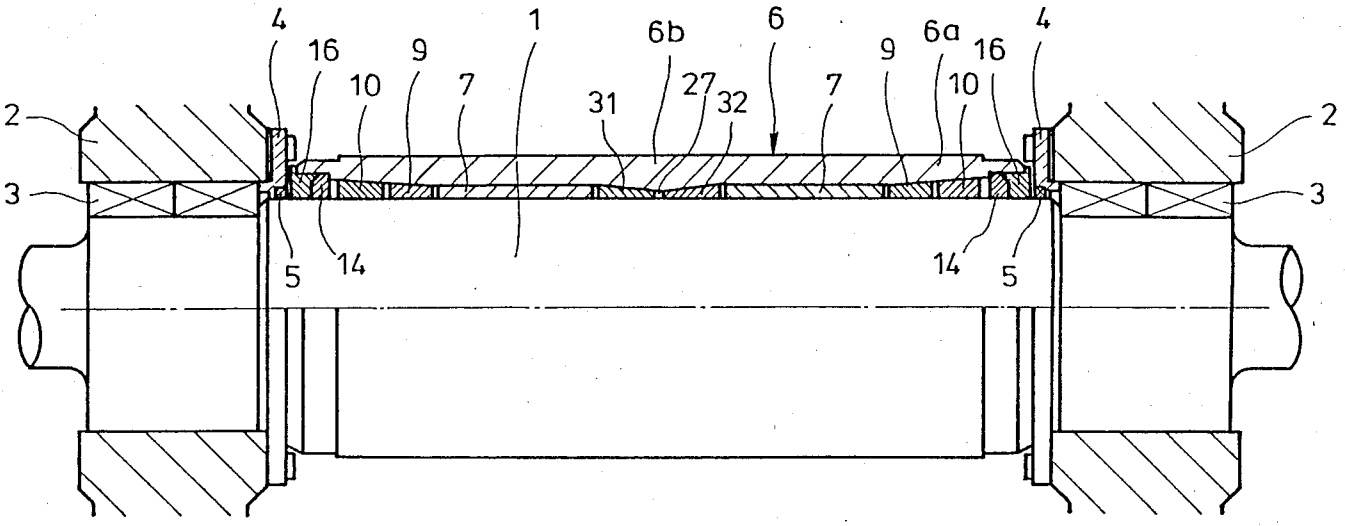
FIG. 6 is a side view, partly in section, of a roll in accordance with the present invention.
Figure 7:
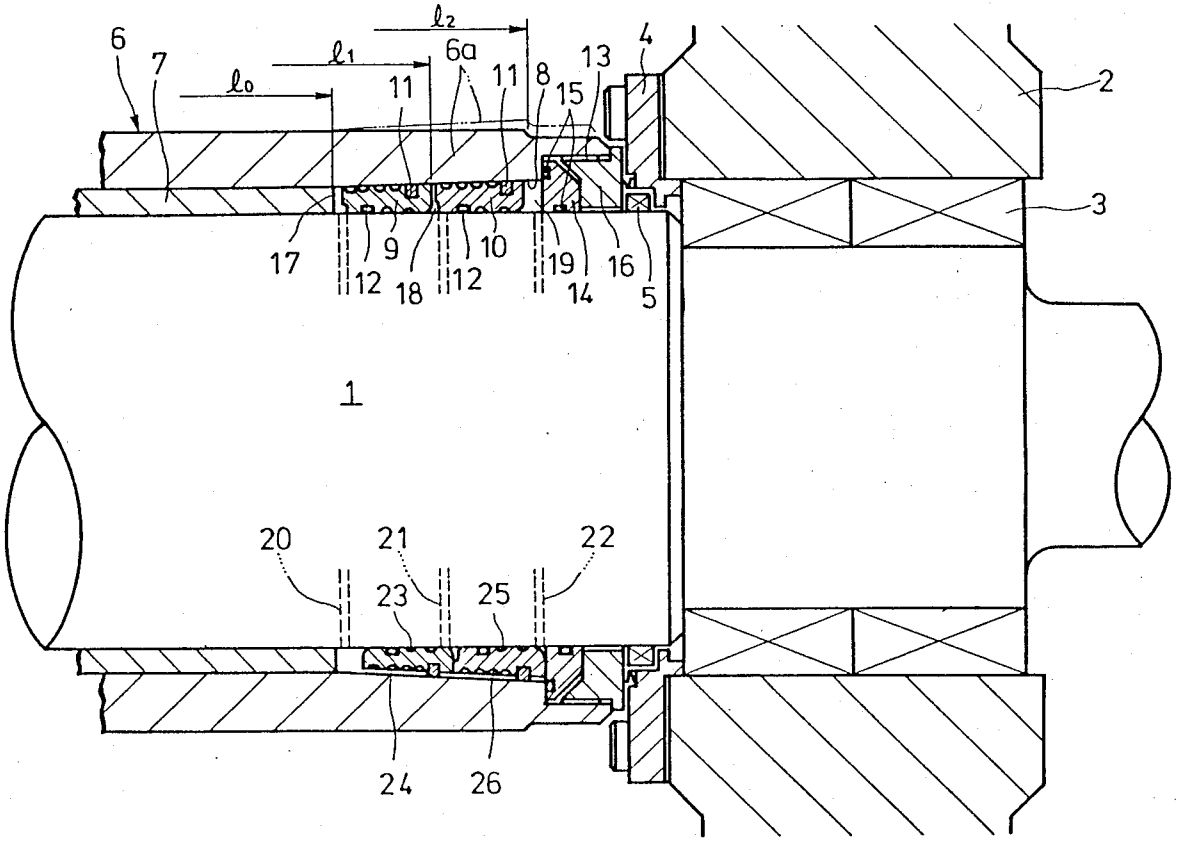
FIG. 7 is a detailed view of an end portion thereof.

FIG. 6 is a side view, partly in section, of a first embodiment of a roll in accordance with the present invention; FIG. 7, a detailed view of the end portion thereof; and FIG. 8, a detailed view of the center portion thereof.

Reference numeral 1 designates a roll core; 2, a bearing box; 3, a bearing; 4, a bearing retainer; and 5, an oil seal fitted into the bearing retainer 4.

A sleeve 6 is fitted over the roll core 1 and is spaced apart by a suitable distance from the outer surface of the roll core 1. The sleeve 6 constitutes a roll barrel. Spacer rings 7 are interposed between the sleeve 6 and the roll core 1 at the quarter portions; that is, the portions spaced apart from the end and center portions of the roll.

The inner surfaces of end portions 6*a* of the sleeve 6 are tapered as indicated by the reference numeral 8 and a pair of tapered rings 9 and 10 are disposed in an annular space defined between the tapered surface 8 of the sleeve end portion 6*a* and the outer surface of the end portion of the roll core 1 such that the tapered rings 9 and 10 are movable in the axial direction of the roll. The outer surfaces of the tapered rings 9 and 10 are so tapered that they mate with the tapered surface 8 of the sleeve end portion 6*a*. The outer surfaces of the tapered rings 9 and 10 are formed with ring grooves for receiving therein piston rings 11. The inner surfaces of the tapered rings 9 and 10 are formed with grooves for receiving therein O-rings 12.

A part of the sleeve end portions 6*a* which extends outwardly beyond the tapered surface 8 has a stepped portion whose diameter is greater than that of the tapered surface 8 and screw threads 13 are formed at the inner surface of the stepped portion. A seal ring 14 is fitted into the stepped portion and an O-ring 15 is fitted between the vertical surface of the seal ring 14 and the vertical wall of the stepped portion while another O-ring 15 is fitted between the inner surface of the seal ring 14 and the outer surface of the roll core 1. The seal ring 14 is securely held in position by means of a ring nut 16 threadably engaged with the screw threads 13.

The space into which the tapered rings 9 and 10 are inserted is maintained oil-tight. A first oil chamber 17 is defined between the outer end of the spacer ring 7 and the inner end of the tapered ring 9; a second oil chamber is defined between the tapered rings 9 and 10; and a third oil chamber 19 is defined between the tapered ring 10 and the seal ring 14. Oil passages 20, 21 and 22 are formed in the roll core 1 and are communicated with the first, second and third oil chambers 17, 18 and 19, respectively, and with an oil source (not shown).

Referring still to FIG. 7, the tapered ring 9 is formed with spiral grooves 23 and 24. The spiral groove 23 is communicated with the second oil chamber 18 while the second spiral groove 24 is communicated with the first oil chamber 17. The tapered ring 10 is also formed with spiral grooves 25 and 26. The first spiral groove 25 is communicated with the third oil chamber 19 while the second spiral groove 26 is communicated with the second oil chamber 18.

In the upper half of FIG. 7 the tapered rings 9 and 10 are shown as being engaged with the tapered surface 8 of the sleeve end portion 6*a*. That is, the rings 9 and 10 are securely engaged between the end portion 6*a* and the roll core 1. But in the lower half of FIG. 7 the tapered rings 9 and 10 are shown as being loosely fitted between the sleeve end portion 6*a* and the roll core 1. That is, the rings 9 and 10 are slightly spaced apart from the tapered surface 8.

Figure 8:
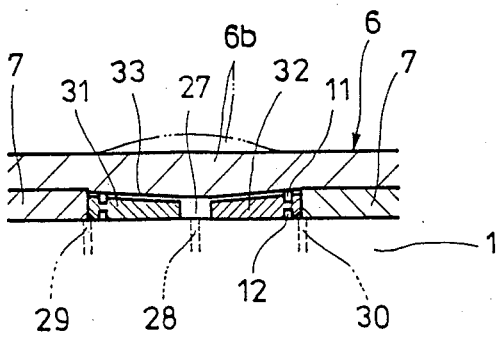
FIG. 8 is a detailed view of a center portion thereof.

An oil chamber 17 is defined between the spacer rings 7 as best shown in FIG. 8 and is communicated with a center oil passage 28 and left and right oil passages 29 and 30. A pair of tapered rings 31 and 32, which are tapered inwardly, are inserted into the oil chamber 27. They are moved toward each other when the oil is forced through the oil passages 29 and 30 into the oil chamber 27, and are moved away from each other when the oil is forced into the oil chamber 27 through the center oil passage 28. The inner surfaces of a center portion 6*b* of the sleeve 6 which define the oil chamber 27 are tapered as indicated by the reference numeral 33. The angle of taper of the tapered surfaces 33 are equal to that of the tapered rings 31 and 32 and is so selected that when the tapered rings 31 and 32 are most spaced apart from each other in the oil chamber 27, there exist small gaps or space between the tapered surfaces 33 and the tapered rings 31 and 32.

Like the tapered rings 9 and 10, the tapered rings 31 and 32 are formed with spiral grooves.

When the oil under pressure is forced into the first oil chamber 17, the tapered rings 9 and 10 are caused to move toward the bearing box 2 so that they are loosely fitted between the roll core 1 and the sleeve 6 (See FIG. 7, the lower half); but when the oil under pressure is forced only into the second oil chamber 18, only the tapered ring 9 is caused to move inwardly and engages with the roll core 1 and the sleeve 6. Then, the oil under pressure is forced into the third oil chamber 19, the tapered ring 10 is caused to move inwardly and wedged between the roll core 1 and the sleeve 6 (See FIG. 7, the upper half).

Thus in response to the pressure of the oil selectively forced into the first, second and third oil chambers 17, 18 and 19, the tapered rings 9 and 10 are forced to move axially outwardly or inwardly. The oilunder pressure flow through the spiral grooves 23, 24, 25 and 26 so that the tapered rings 9 and 10, the roll core 1 and the sleeve end portion 6*a* are lubricated and the sleeve end portion 6*a* is expanded. As a result, the axial movement is facilitated.

When the rolls of the type described above are incorporated into a rolling mill and when the tapered rings 9 and 10 are loosely fitted between the roll core 1 and the sleeve 6, the rolling force exerted to the sleeve end portion 6*a* is not transmitted to the end portion of the roll core 1. As a result, when both the tapered rings 9 and 10 are loosely fitted, the effective length of the roll along which the rolling force is transmitted is $l_0$. When only the tapered ring 9 is wedged between the roll core 1 and the sleeve 6, the rolling force is transmitted through the tapered ring 9 so that the effective roll length becomes $l_1$. When both the tapered rings 9 and 10 are wedged between the roll core 1 and the sleeve 6, the effective roll length becomes $l_2$.

When the pressure of the working oil is increased so that the tapered rings 9 and 10 are deeply wedged between the roll core 1 and the sleeve 6, the sleeve end portion 6*a* is expanded as indicated by the imaginary lines in FIG. 7. As a consequence, the cross section profile of the roll can be varied so that the cross section of the strip being rolled is more accurately controlled. In the structure shown, the axially inward movement of the tapered rings 9 and 10 causes the sleeve end portion 6*a* to expand and become larger in diameter than the other portions of the sleeve. Alternatively, the arrangement may be such that the axially inward movement of the tapered rings 9 and 10 causes the sleeve end portion 6*a* to expand and become equal in diameter to the other portions of the sleeve. In such a case, when the rings 9 and 10 are moved axially outwardly or toward the bearing box 2, the sleeve end portion 6*a* is contracted to become smaller in diameter than the other portions of the sleeve, with the rings 9 and 10 being neatly fitted with or slightly spaced apart from the tapered surface 8. It is needless to say that which arrangement to adapt is dependent on use of a roll.

Referring next to FIG. 8, when the oil passages 29 and 30 are closed so that the oil under pressure is forced only into the oil passage 28, the sleeve center portion 6*b*, i.e., the surface profile of the sleeve or roll is expanded as indicated by the imaginary line. That is, the roll is formed with a crown. Under these conditions, the rolling with a light rolling force can be accomplished as in the case of the conventional rolls.

When the oil under pressure is forced through the oil passages 29 and 30, the tapered rings 31 and 32 are moved toward each other. As a result, the tapered surfaces of the tapered rings 31 and 32 engage with the tapered surfaces 33 of the sleeve center portion 6*b*; that is, the tapered rings 31 and 32 are wedged between the roll core 1 and the sleeve 6. As a consequence, the surface profile of the roll is expanded to form a crown as indicated by the imaginary line. The roll crown thus formed substantially similar to that formed when the oil under pressure is forced into the oil chamber 27 through the oil passage 28, but it should be noted that the tapered rings 31 and 32 are wedged between the roll core 1 and the sleeve center portion 6*b* so that the roll is substantially similar to a solid roll. As a consequence, the roll can be used for the high pressure rolling which cannot be accomplished so far with the conventional rolls.

When used as a solid roll, the expansion of the sleeve center portion 6*b* can be suitably controlled by adjusting the positions of the rings 31 and 32.

Another method for expanding the sleeve center portion 6*b* is to supply the oil under pressure through the center oil passage 28 into the chamber 27 and then to cause the tapered rings 31 and 32 to move toward each other. Alternatively, first the tapered rings 31 and 32 are caused to move toward each other and then the oil under pressure is forced through the oil passages 28, 29 and 30.

In the case of rolling, depending upon the width and shape of a strip to be rolled, the positions of the tapered rings 9, 10, 31 and 32 are suitably adjusted so that the rolling precision can be remarkably improved. It is possible to combine the roll of the present invention with the work roll bending procedure so that the cross section of the strip being rolled can be controlled with high degree of accuracy.

Figure 9:
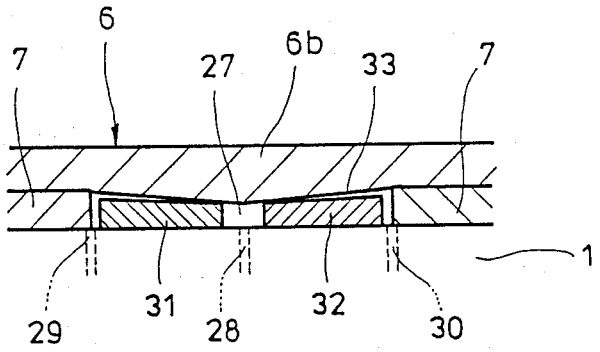
FIG. 9 is a sectional view of the center portion of another embodiment of the present invention.
Figure 10A:
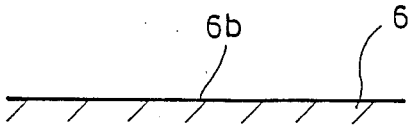
FIGS. 10A through 10D are views showing the variations in roll profile.
Figure 10B:
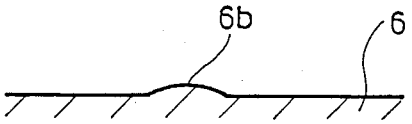
Figure 10C:
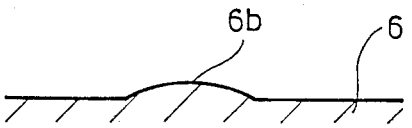
Figure 10D:
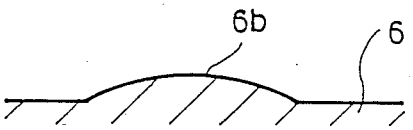

In FIG. 9 is shown another emboidment of the present invention. The taper angle of the tapered surfaces 33 on the sleeve center portion 6*b* is slightly greater than that of the tapered rings 31 and 32. In this case, the surface of the sleeve center portion 6*b* i.e., the roll surface profile can be gradually increased as shown in FIGS. 10A through 10D.

Figure 11:
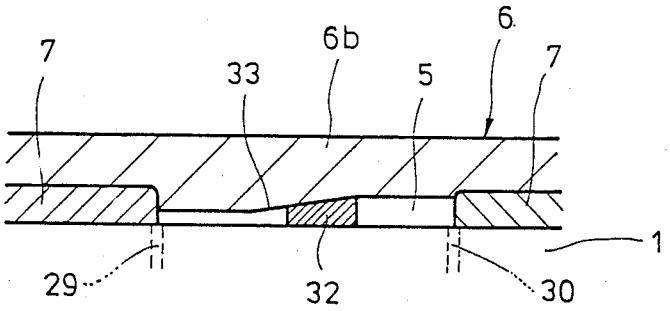
FIG. 11 is a sectional view of the center portion of a further embodiment of the present invention.

In FIG. 11 is shown a further embodiment of the present invention in which only the tapered ring 31 or 32 is used to change the profile of the sleeve center portion 6*b*. In this embodiment, the central oil passage 28 is not needed. In like manner, at the end portions only the tapered ring 9 or 10 may be used.

In the above embodiments, the oil-tight space which is defined between the roll core end portion and the sleeve end portion and into which the tapered rings are inserted is defined by fitting the sleeve over the roll core through the spacer rings 7. Alternatively, the oil-tight space may be defined between a stepped portion of the roll core end portion and the sleeve which is directly fitted over the roll core. Alternatively, the oil-tight space may be defined between the roll core and a stepped portion of the sleeve end portion.

In the above embodiments, the movable rings are rings whose tapered surfaces are flat, but it is to be understood that the tapered surfaces of the movable rings may be slightly convex and the inner surface of the sleeve may be complementary tapered. Moreover, it is to be understood that rings with no taper may be also used.

The inner surfaces on the sleeve end portion and the sleeve center portion have been described as being tapered but it is to be understood that the inner surfaces of the sleeve end portion and the sleeve center portion may be flat while the outer surface of the roll core may be tapered. Alternatively, both the inner surfaces of the sleeve and the outer surface of the roll core may be tapered. It is further to be understood that various modifications may be effected without leaving the true spirit of the present invention.

Figure 12:
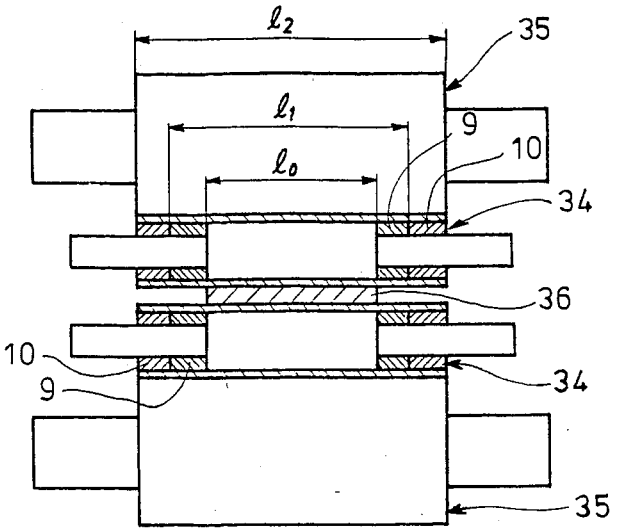
FIGS. 12 and 13 show rolling mills incorporating the rolls in accordance with the present invention.

FIG. 12 shows a rolling mill in which the rolls of the present invention are used as work rolls. Reference numeral 34 designates work rolls; and 35, backup rolls.

As shown in FIG. 12, when a strip 36 with a relatively small width is rolled, both the rings 9 and 10 are loosely fitted; that is, they are not wedged between the roll core and the sleeve. As a result, the rolling force is not transmitted at the end portions of the roll. Under these conditions, the effective roll length of the work roll 34 becomes $l_0$.

When a strip with a medium width is to be rolled, only the tapered rings 9 are wedged between the roll core and the sleeve 6. In this case, the effective length of the work roll 34 becomes $l_1$. When a strip with a greater width is to be rolled, both the tapered rings 9 and 10 are wedged between the roll core 1 and the sleeve 6. In this case the effective length of the work roll 34 becomes $l_2$.

Depending upon the width of a strip to be rolled, the tapered rings 9 and 10 are loosened or wedged in the manner described above. But even when a strip with a relatively small width is being rolled, the work rolls may have thermal crowns under some rolling conditions so that sometimes it is preferable that the work rolls are bent under the rolling force. In this case, the tapered rings 9 and 10 are wedged between the roll core 1 and the sleeve 6 so that the curved profile of the work roll 34 may be transferred to the strip 36 being rolled. Depending upon the rolling conditions, the tapered rings 9 and 10 are loosened or wedged so that the effective length of the work rolls is varied and the crown of the strip being rolled is controlled.

Depending upon whether or not the tapered rings 9 and 10 are wedged between the roll core 1 and the sleeve 6, the bending conditions of the work rolls are varied over a wide range. Therefore in order to make a fine adjustment of the bending of the work rolls, the work roll bending procedure may be employed.

Sometimes it is required to reduce the crown of a strip being rolled. In this case, the tapered rings 9 and 10 are loosened. As a result, the work roll 34 is bent in the opposite direction so that the crown of the strip being rolled is reduced too much; that is, a negative crown is developed. In this case, the work roll bending force is decreased so as to provide an optimum crown.

Figure 13:
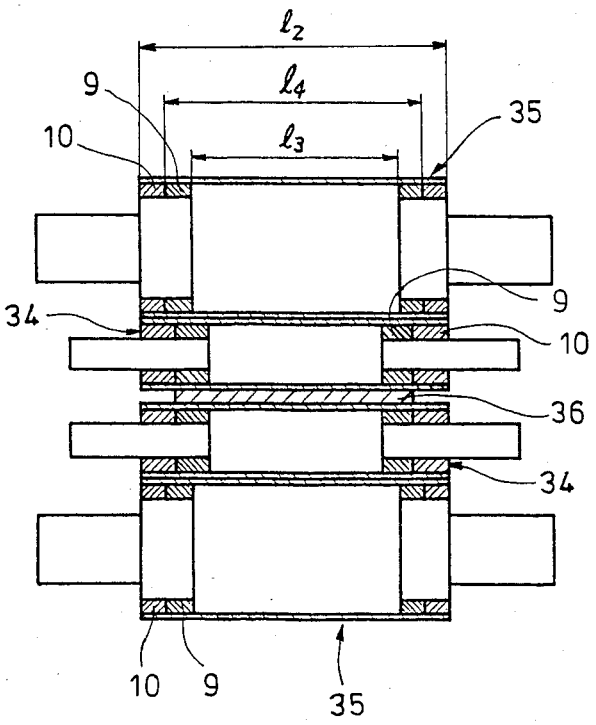

So far the mode of operation of the four-high rolling mill with the work rolls according to the present invention has been described, but it is to be understood that the rolls of the present invention can be used as backup rolls as shown in FIG. 13. In the latter case, the effective roll length becomes $l_3$ or $l_4$.

It is needless to say that various strips with different width can be rolled by varying the width of the tapered rings of the upper and lower work rolls and backup rolls and by varying the combinations of the loosened and wedged tapered rings. The number of the tapered rings may be one or more than three.

Furthermore, the rolls in accordance with the present invention may be incorporated, as intermediate rolls, in a six-high rolling mill.

The effects, features and advantages of the present invention can be summarized as follows:

(i) The effective lengths of the work, backup and intermediate rolls can be varied (the rolling force can be varied) so that the bending of the work rolls can be controlled.

(ii) The crown of a strip being rolled can be optimumly controlled so that the yield can be improved, the cross section accuracy can be enhanced and the energy saving can be attained.

(iii) Without exchanging the work rolls, strips with different widths can be rolled so that the operation rate of the rolling mill can be remarkably improved.

(iv) The rolling forces are symmetrical about the center of the rolling mill so that the zig-zag movement of the strip being rolled can be prevented.

(v) The rolls of the present invention can be used as solid crown rolls so that the rolling with various rolling forces can be accomplished.

(vi) The rolling mill incorporating the rolls in accordance with the present invention can roll strips with various widths so that the operation rate of the rolling mill can be considerably increased.

(vii) Regardless of the width of a strip being rolled, the cross section control can be optimumly accomplished by the work roll bending procedure.

What is claimed is:

1. A roll used in a rolling mill comprising a roll core, a sleeve fitted over the length of said roll core, means defining a liquid-tight chamber between an end portion of said roll core and an end portion of said sleeve, said liquid-tight chamber having opposing surfaces, at least one of the opposing surfaces of said liquid-tight chamber being tapered, an axially movable tapered ring interposed between the opposing surfaces of said liquid-tight chamber, and means connected with said liquid-tight chamber for forcing a liquid therein for moving said tapered ring axially toward the center portions of said roll core and sleeve so that the end portion of said sleeve is radially expanded, whereby the roll profile is varied.

2. A roll used in a rolling mill comprising a roll core, a sleeve fitted over the length of said roll core, means defining a liquid-tight chamber between a center portion of said roll core and a center portion of said sleeve, said liquid-tight chamber having opposed surfaces, at least one of the opposing surfaces of said liquid-tight chamber being tapered, an axially movable tapered ring interposed between the opposing surfaces of said liquid-tight chamber, and means connected with said liquid-tight chamber for forcing a liquid therein for moving said tapered ring axially toward the center portions of said roll core and sleeve so that the center portion of said sleeve is radially outwardly expanded, whereby the roll profile is varied.

* * * * *